US011015886B1

(12) United States Patent
Lee

(10) Patent No.: US 11,015,886 B1
(45) Date of Patent: May 25, 2021

(54) CHARGING HANDLE ASSEMBLY

(71) Applicant: Strike Industries, Santa Ana, CA (US)

(72) Inventor: Shanyao Lee, Irvine, CA (US)

(73) Assignee: Strike Industries, Santa Ana, CA (US)

( * ) Notice: Subject to any disclaimer, the term of this patent is extended or adjusted under 35 U.S.C. 154(b) by 0 days.

(21) Appl. No.: 16/698,344

(22) Filed: Nov. 27, 2019

(51) Int. Cl.
*F41A 3/72* (2006.01)
*F41A 35/06* (2006.01)

(52) U.S. Cl.
CPC ..... *F41A 3/72* (2013.01); *F41A 35/06* (2013.01)

(58) Field of Classification Search
CPC ..... F41A 3/72; F41A 35/06
See application file for complete search history.

(56) References Cited

U.S. PATENT DOCUMENTS

| | | | | |
|---|---|---|---|---|
| 9,482,479 | B1 * | 11/2016 | Jen | F41A 3/72 |
| 9,488,424 | B1 * | 11/2016 | Kincel | F41A 3/72 |
| 2016/0320151 | A1 * | 11/2016 | Kincel | F41A 3/72 |
| 2018/0010868 | A1 * | 1/2018 | Bailey | F41A 5/26 |

* cited by examiner

*Primary Examiner* — J. Woodrow Eldred
(74) *Attorney, Agent, or Firm* — Jen-Feng Lee, Esq.

(57) ABSTRACT

Present invention discloses a rifle charging handle where one or two polymer pieces are made to fit over a T distal end of a main rigid body. A small protrusion on a hook shape latch, with limited elasticity, provides the locking mechanism to the upper receiver. The polymer pieces are secured by screws or other means; they provide a cost-effective option for ambidexterity variation and reduce metal wear on the upper receiver. The polymer pieces can also be secured to the main rigid body via a click-tab/click-hole mechanism. Other composite materials can be used to make the polymer pieces as long as they provide substantially similar rigidness and limited elasticity.

8 Claims, 11 Drawing Sheets

CHARGING HANDLE ASSEMBLY

FIELD AND BACKGROUND OF THE INVENTION

Tradition rifle charging handle include at least four components: Main body "MB" made from metal such as aluminum or steel, or other expensive composite materials), Latch "L" (similar materials as the Main Body), Roll Ping ("RP") (metal) and a spring.

FIGS. 1, 2*a* and 2*b* show the prior art rifle charging handles.

The latch L is secured by a roll pin RP to the main body MB. The spring gives the latch the force to lock on the upper receiver. Once assembled and put on a firearm upper receiver, the latch will lock on the upper receiver by the force provided by the spring.

When a user pulls back (aka "charge") the charging handle, the fingers will hold on the support surfaces and pull back. The force from human fingers is much bigger than the latch locking force provided by the spring; the latch will be "unlocked" from the upper receiver and allow the pull-back action to take place.

Such traditional design is complicated and hard to assemble and disassemble. Worse yet, the latch is normally made of steel or comparable metal materials. Repeated lock and unlock actions tend to wear out the upper receiver and gradually cause the locking function to become weaker and ultimately lost.

There are certain "latchless" designs on the market. For example, U.S. Pat. No. 9,175,913, issued on Nov. 3, 2015, disclosed and claimed a design that uses a detent ball, instead of a [spring+latch] combination, to work out the locking function. At 5:47-54, The 913 patent described the "detent ball assembly (102) comprises a detent ball residing within a bored detent ball assembly cylinder; the detent ball being pressed by the spring. When a user actuates the latchless charging handle, the user's hand action causes the detent ball to depress into the detent ball assembly cylinder. The mechanical complexity, shown in FIG. 4 and as described, is not reduced by much.

Another "latchless" design is shown in U.S. Pat. No. 9,976,823, issued on May 22, 2018. This patent uses a "roller wheel" (130), held by a roller arm 110, to engage in a detent 140 in the upper receiver of a rifle, thus providing a substantially frictionless operation of the latch release and ambidextrous options for the charging handle design.

FIG. 9 shows the roller arm 110, when pressed by human hand to release the latch, causes the roller wheel 140 to roll out of the detent 140. The mechanical implementation of this roller wheel design, nonetheless, remains to be quite complex.

Present invention adopts a simple design of a main body with one (or two) polymer pieces secured by screw(s) to the main body. The polymer material is cost-effective, sturdy and less prone to wear out the upper receiver.

Through repeated use and normal wear and tear, present invention's "add-on" polymer piece construction provides better economy for improving the loss of the latching function, compared to other old-art latching, or the "latchless" design, due to lower cost of polymer replacement, or other similar composite materials.

SUMMARY OF THE INVENTION

The invention relates to a charging handle assembly for working with a rifle's upper receiver. Particularly for the AR-15, or compatible, type rifles.

The charging handle assembly of present invention contains a rigid main body shaped in a long bar; one end of the long bar is formed into a T distal end and the other end is a tail end.

Instead of using metal, present invention uses polymer as the material and shaped to fit the T distal end. This reduces the friction between the metal (upper receiver and traditional charging handle latching), with a lower cost factor.

The polymer piece further has a hook shape latch containing a small protrusion. The hook shape latch is made to have limited elasticity for slidably hooking into a hole on an upper receiver of a rifle. The polymer piece has an easy surface for human hand to grab onto for performing the desired charging action.

Screw(s) can be used to secured the polymer piece to the T distal end of the main rigid body.

Another embodiment of present invention uses two polymer pieces: a left polymer piece and a right polymer piece that are substantially mirror images of each other and jointly fit over the T distal end.

The right polymer piece further has a hook shape latch containing a small protrusion. The 2-piece construction works in a way similar to the one-polymer-piece construction.

The two polymer pieces can be secured to the long bar of the main rigid body either by screws or by alternative click-tab/click-hole mechanism where the polymer pieces have holes for snugly receiving matching pegs on the T distal end of the long bar.

The design of using polymer piece(s) to fit over the T distal end provides users with greater flexibility and modularity options to shape the contact surfaces for the hands/fingers and for ambidexterity variations.

The polymer piece(s) can be made from polymer, or other composite materials as long as they provide substantially similar attribute of rigidness and limited elasticity that is equivalent to the polymer material herein.

DESCRIPTION OF THE DRAWINGS

The accompanying drawings exemplify the preferred embodiments of the invention. Together with the description, serve to explain the principles of the invention.

A brief description of the drawings is as follows.

DETAILED DESCRIPTION OF THE PREFERRED EMBODIMENT

Figure 1:
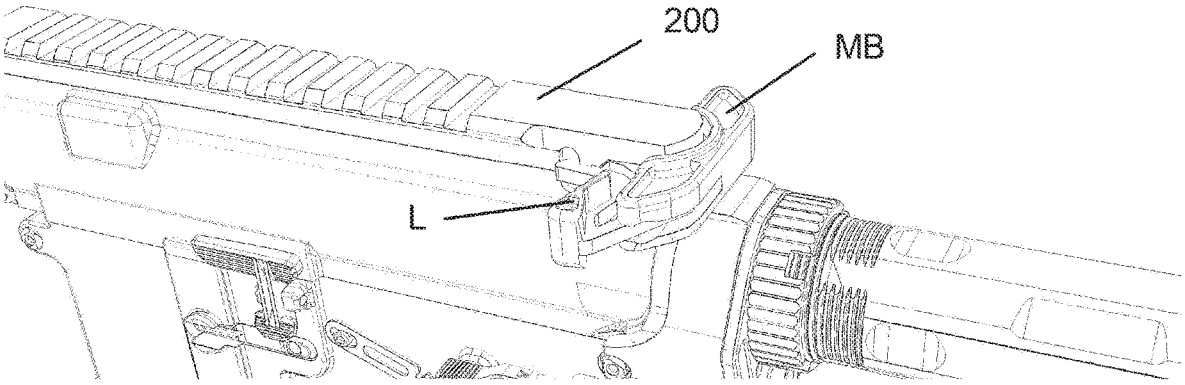
Fig. 1 (Prior Art)
FIG. 1 shows the prior art implementation of a charging handle latch design.
Figure 2A:
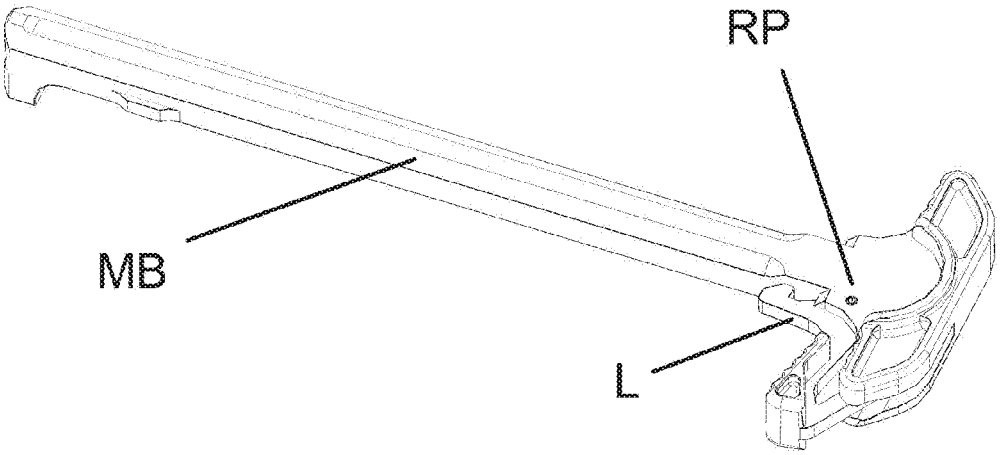
Fig. 2a (Prior Art)
FIGS. 2*a* and 2*b* show the focused view of a prior art implementation of a charging handle latch design.
Figure 2B:
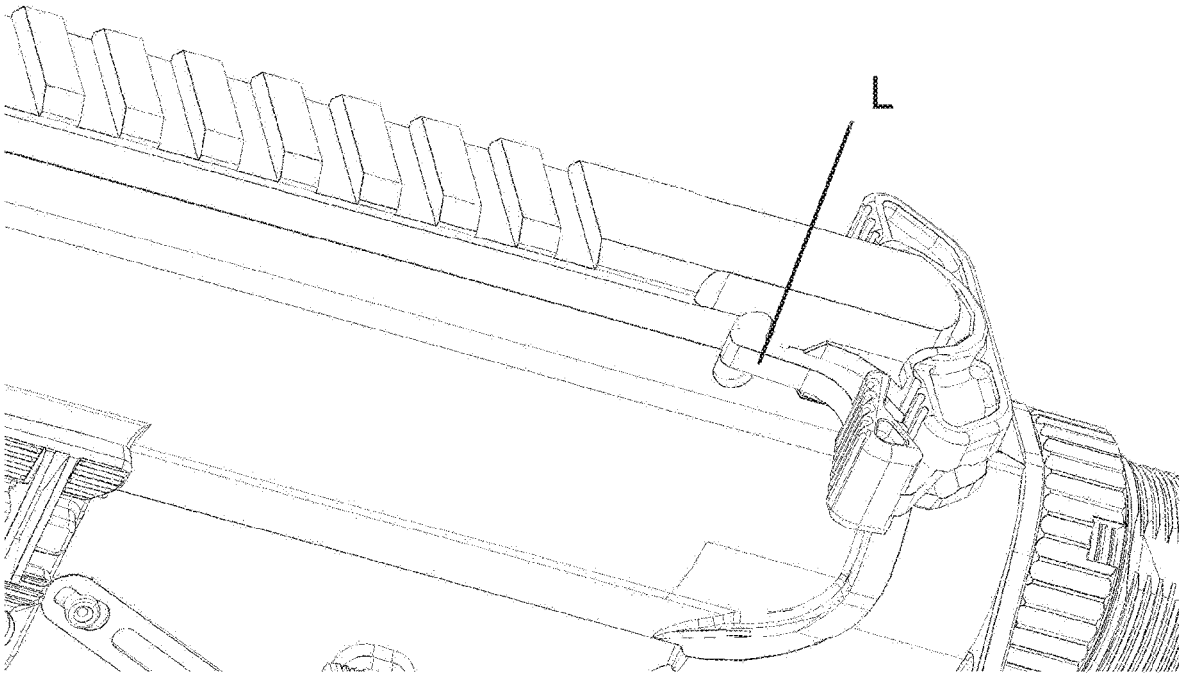
Fig. 2b (Prior Art)
Figure 3:
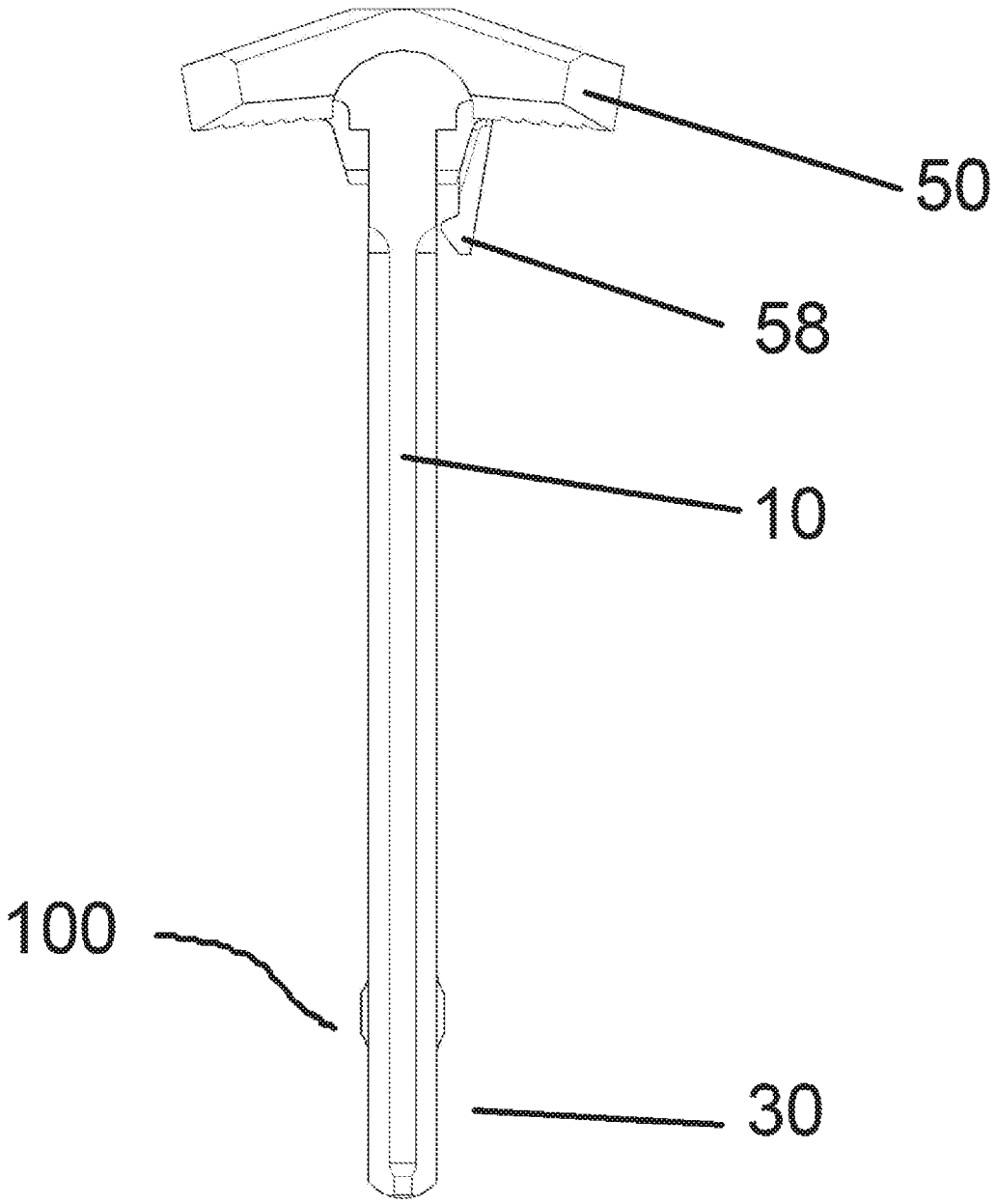
FIG. 3 shows the one polymer piece construction of present invention.
Figure 4A:
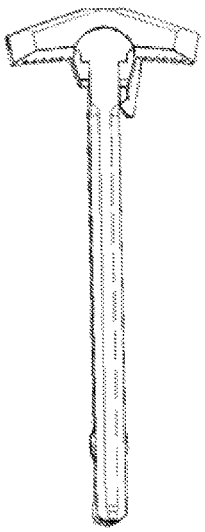
FIGS. 4*a* and 4*b* show the assembled and disassembled views of one polymer piece construction.
Figure 4B:
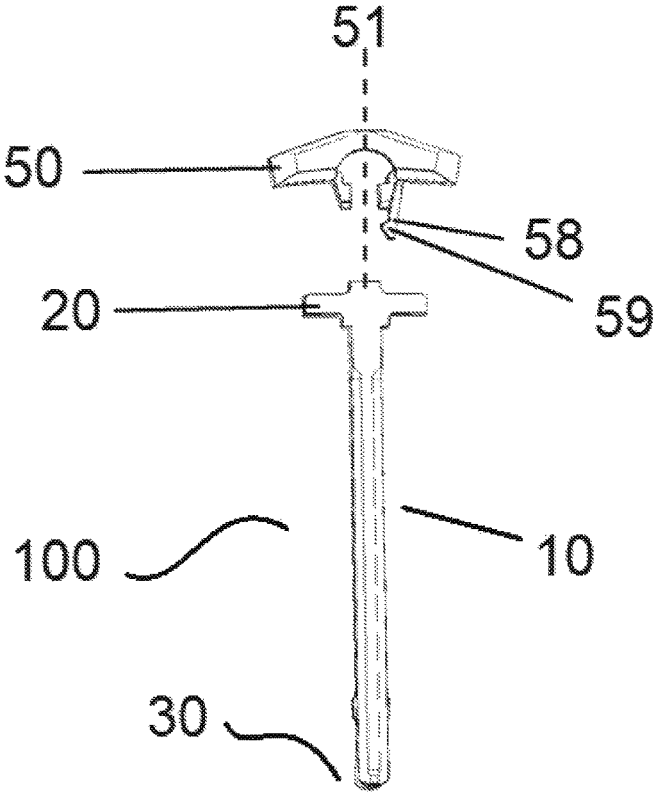
Figure 5A:
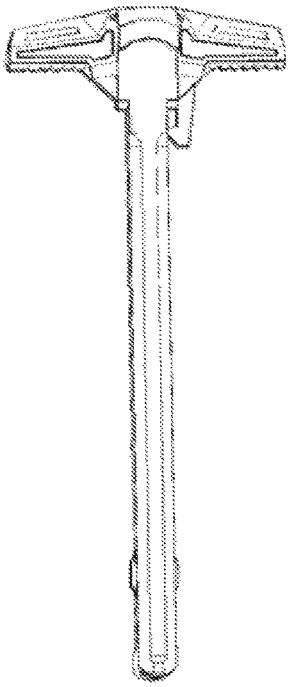
FIGS. 5*a* and 5*b* show the assembled and disassembled views of two polymer piece construction.
Figure 5B:
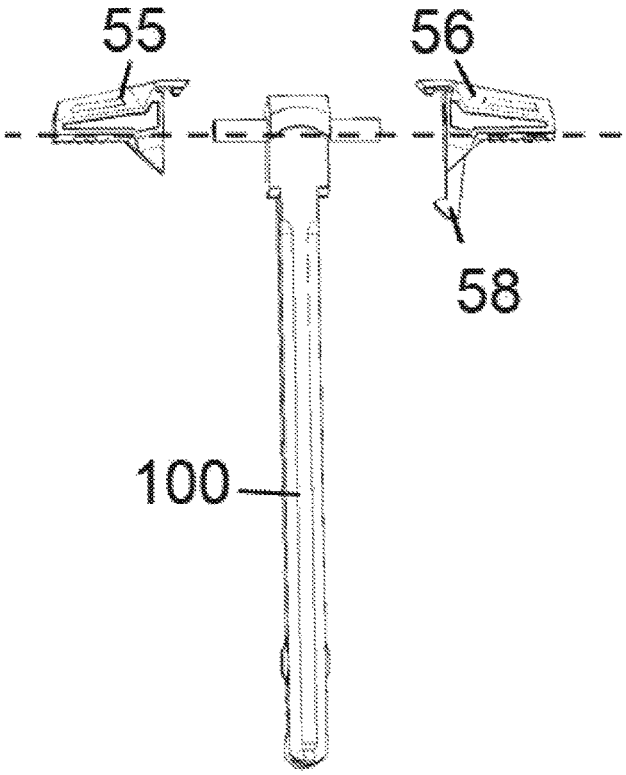

As shown in FIGS. 3, 4*a* and 4*b*, the charging handle assembly of present invention contains a rigid main body 100 shaped in a long bar 10; one end of the long bar 10 is formed into a T distal end 20 and the other end is a tail end 30. The long bar 10 may have an elongated slot along the lengthwise orientation.

A polymer piece 50 has a concave space made to snugly fit over said T distal end 20. With the polymer piece 50 fitted on the T distal end 20, it is easier for a human hand to grab on to the charging handle on an upper receiver 200 of a rifle and perform the desired charging action.

The polymer piece 50 further has a hook shape latch 58 containing a small protrusion 59, as shown in FIGS. 4*a*, 4*b*, 5*a*, and 5*b*. The hook shape latch 58 is made to have limited elasticity for slidably hooking into a hole on an upper receiver 200 of a rifle.

The polymer piece 50 is assembled to the T distal end 20 by means that allow securely attaching to the T distal end 20 and easy detaching away from the T distal end 20.

One embodiment of the means is by the use of a screw 66 and at least a screw hole 51 on the polymer piece 50, whereby the polymer piece 50 can be installed into a matching screw hole on the T distal end 20.

Figure 6:
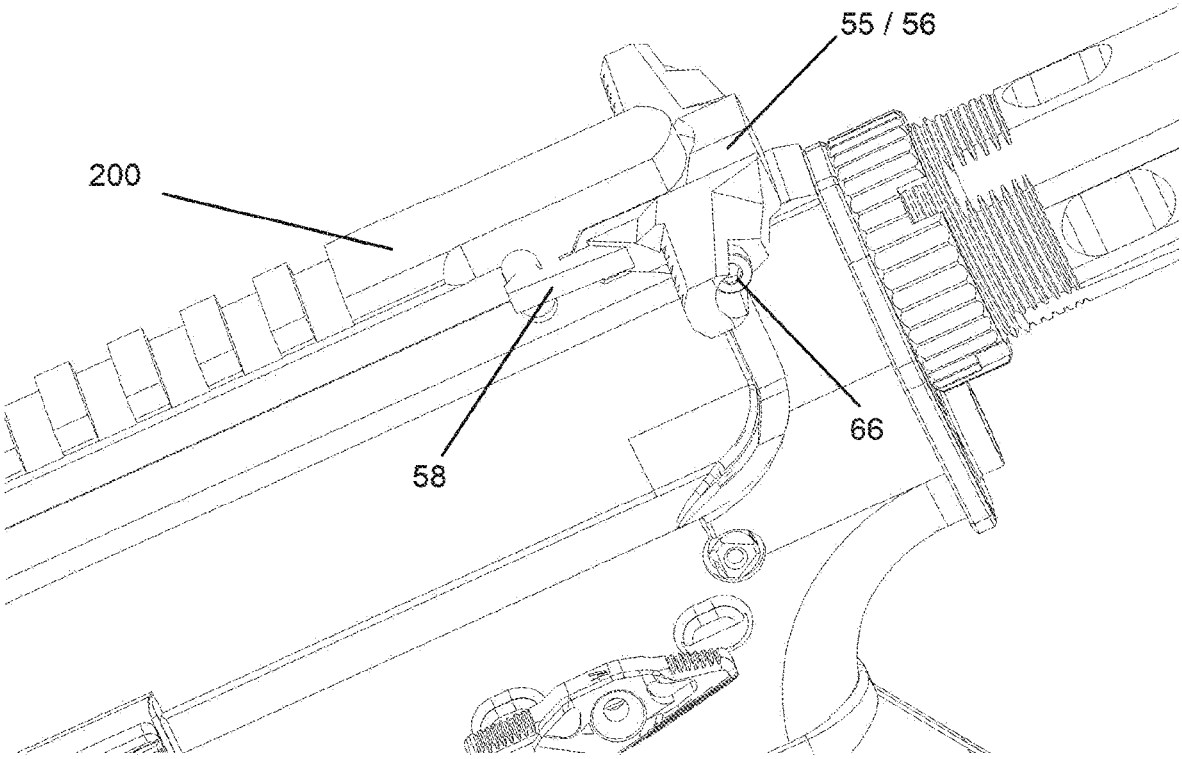
FIG. 6 shows the perspective view of two polymer piece construction.
Figure 7:
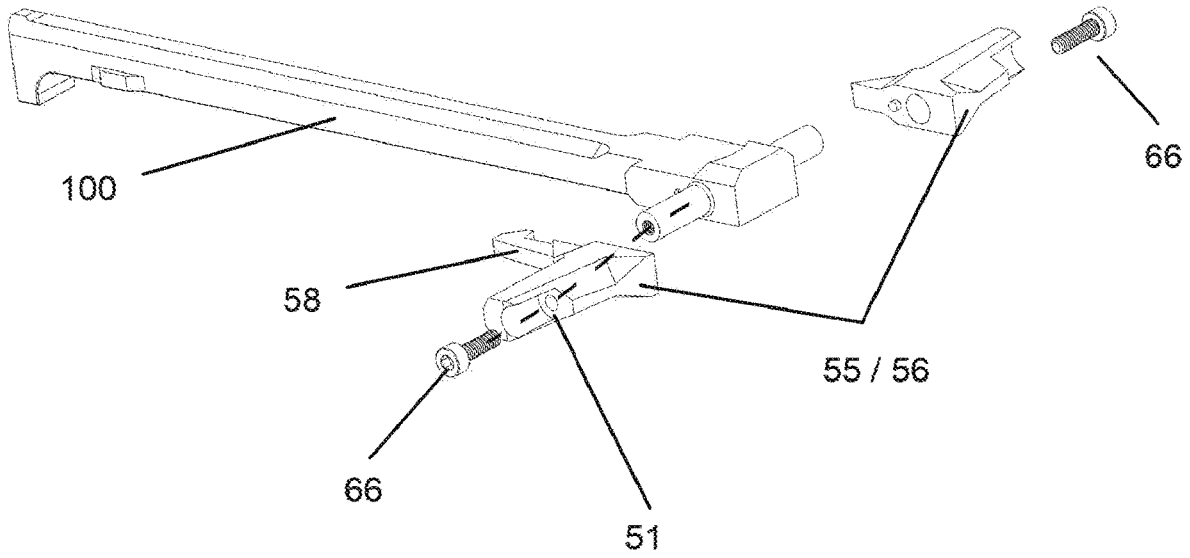
FIG. 7 shows the exploded view of two polymer piece construction, with each piece being secured to the long bar with a screw.

Another embodiment of present invention uses two polymer pieces: a left polymer piece 55 and a right polymer piece 56 to fit over the T distal end 20 on the long bar 10 of the rigid main body 100. FIG. 6 shows the perspective view of the two polymer piece construction. FIG. 7 shows the exploded view.

The two polymer pieces 55 and 56 are substantially mirror images of each other and jointly defining a concave space made to snugly fit over said T distal end 20.

The right polymer piece 56 further has a hook shape latch 58 containing a small protrusion 59; said hook shape latch 58 is made to have limited elasticity for slidably hooking into a hole on an upper receiver 200 of a rifle.

The polymer pieces 55 and 56 are assembled to the T distal end 20 by means that allow securely attaching to the T distal end 20 and easy detaching away from the T distal end 20.

One embodiment of the means is by the use of at least a screw 66 and at least a screw hole 51 on each of the polymer pieces 55 and 56, whereby the polymer pieces 55 and 56 can be installed/tightened into a corresponding screw hole on the T distal end 20.

Figure 8A:
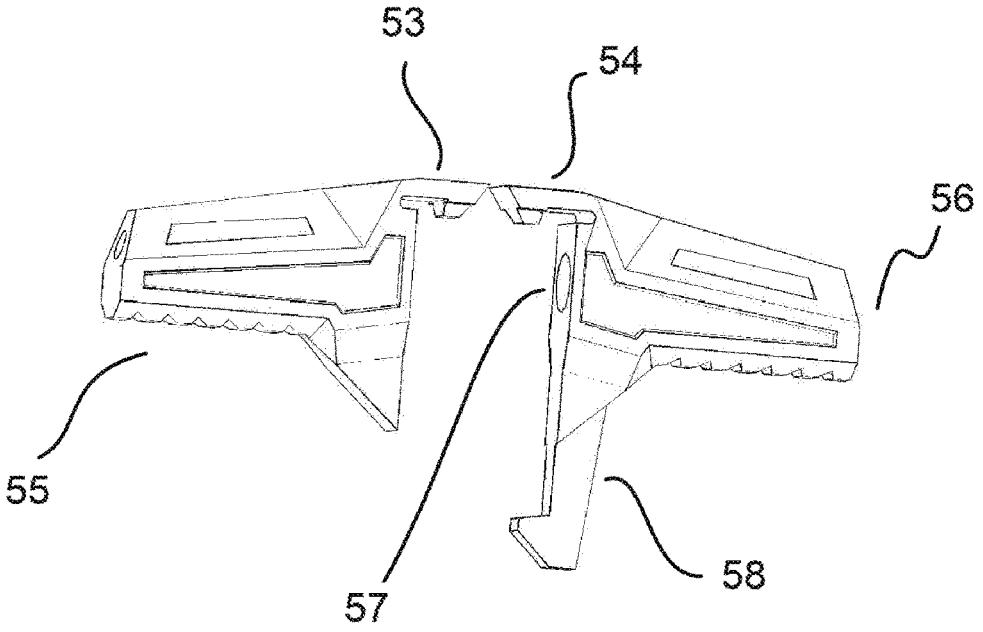
FIGS. 8*a* and 8*b* show the two-piece construction with click-tab/click-hole mechanism to secure the polymer pieces.

Another embodiment of the means to secure the two polymer pieces 55/56 to the long bar 10, without using any screws, is to have extending click tabs 53 and 54 made respectively on polymer pieces 55 and 56, as shown in FIG. 8*a*. A small protrusion is formed at a distal end of each of the click tabs 53/54.

Figure 9:
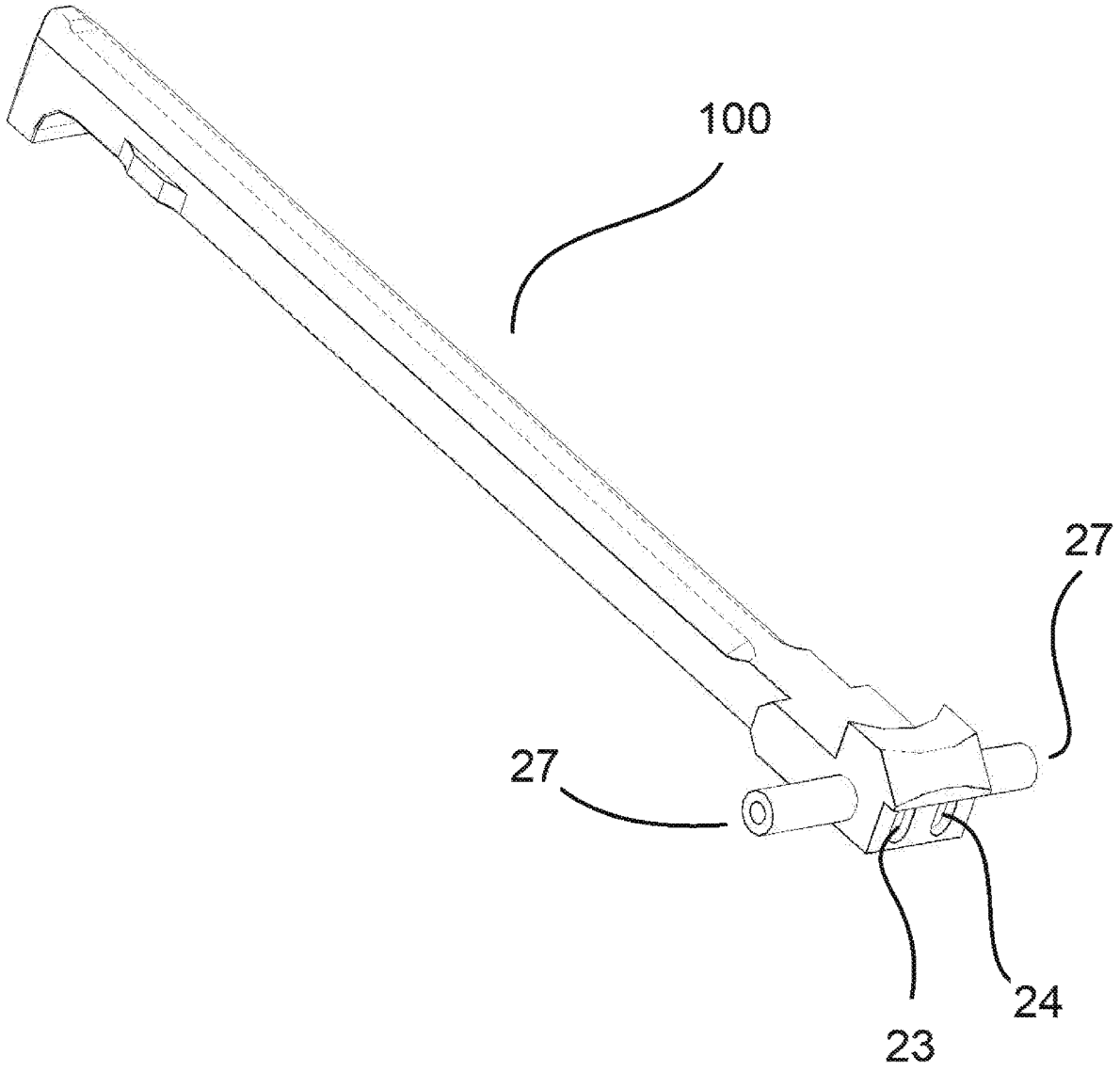
FIG. 9 shows the out-extending pegs for inserting into holes of the polymer pieces.
Figure 10:
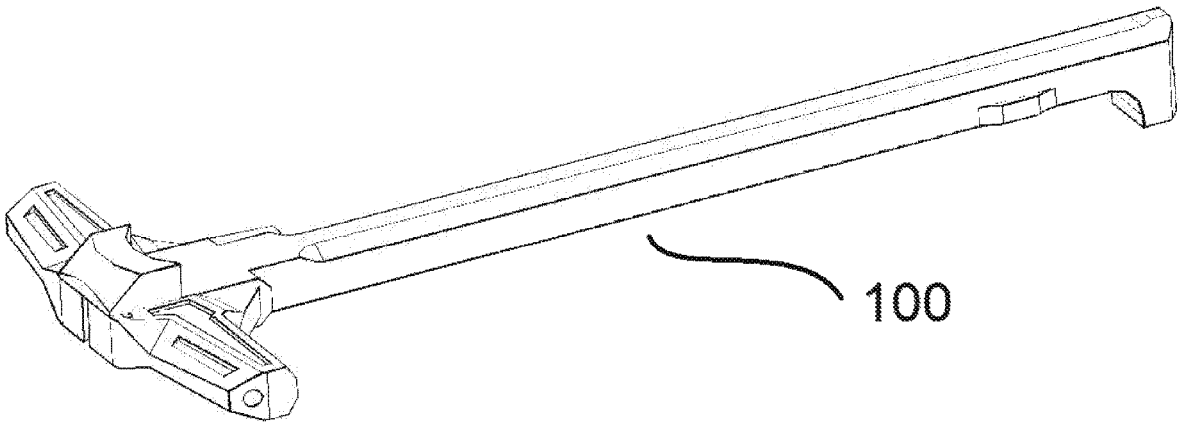
FIG. 10 shows the two polymer pieces secured to the T distal end of the long bar without using a screw.

Two matching click holes 23 and 24 are made on the T distal end 20, corresponding to the position of and for receiving the to click tabs 53 and 54. The two click holes 23/24 are shown in FIG. 9.

Two out-extending pegs 27 are at the T distal end 20, extending out in a direction transverse to the lengthwise direction of the long bar 10, for snugly inserting into corresponding insertion holes 57 on the two polymer pieces 55 and 56.

Figure 8B:
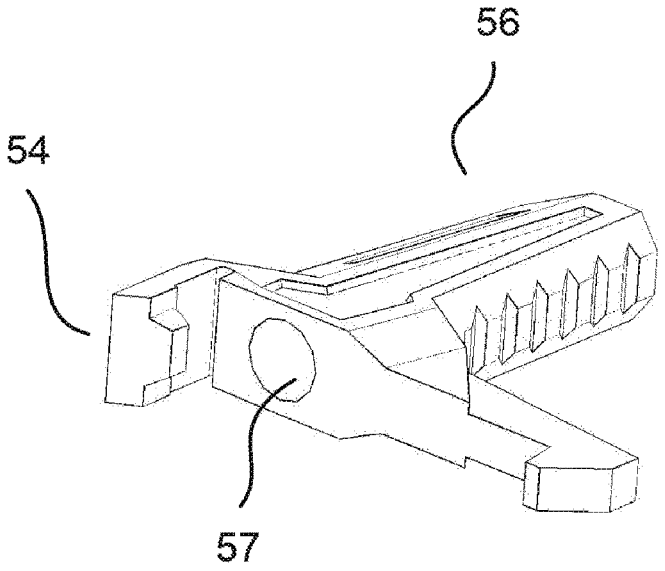

FIG. 8*b* shows the insertion hole 57 and the click tab 54 for the right polymer piece 56. FIG. 9 shows the two polymer pieces 55/56 installed onto the T distal end 20 of the long bar 10, without any screw.

The polymer piece(s) can be made from polymer or other composite materials as long as they provide substantially similar attribute of rigidness and limited elasticity that is equivalent to the polymer material herein.

The invention claimed is:

1. A charging handle assembly, comprising:

a rigid main body having a long bar with a T distal end and a tail end; and a polymer piece having a concave space made to fit over the T distal end wherein the polymer piece further has a hook shaped latch with a hook tooth configured to engage a charging handle notch of an upper receiver, wherein the hook shaped latch has limited elasticity for slidably hooking into the charging handle notch of an upper receiver of a rifle, wherein the hook shape latch has a hook tooth with a negative rake angle when engaged to the charging handle notch of an upper receiver.

2. The charging handle assembly of claim 1, wherein the polymer piece has at least one screw hole to receive a screw for tightening the polymer piece into a matching screw hole on the T distal end of the main rigid body, wherein the T distal end of the main rigid body is rigid.

3. A charging handle assembly, comprising:

a rigid main body having a long bar with a T distal end and a tail end;

a left polymer piece, and a right polymer piece, wherein the two polymer pieces are substantially mirror images of each other and jointly defining a concave space made to snugly fit over said T distal end, and the right polymer piece further has a hook shape latch containing a small protrusion, said hook shape latch is made to have limited elasticity for slidably hooking into a hole on an upper receiver of a rifle, wherein the each of the left and right polymer pieces further has a click tab with a small protrusion formed at a distal end of the click tabs, and two matching click holes are made on the T distal end for receiving the click tabs, and wherein the T distal end has two out-extending pegs for snugly inserting into corresponding insertion holes on the two polymer pieces.

4. The charging handle assembly of claim 3, wherein the left and right polymer pieces are assembled to the T distal end by means that allow securely attaching to the T distal end and easy detaching away from the T distal end.

5. The charging handle assembly of claim 3, wherein the means for attaching and detaching the polymer pieces is by the use of at least a screw and at least a screw hole on each of the polymer pieces, so that the screws install the polymer pieces by tightening into matching screw holes on the T distal end.

6. The charging handle assembly of claim 3, wherein the polymer pieces can be made from other materials as long as they provide substantially similar attribute of rigidness and limited elasticity equivalent to the polymer material used herein.

7. A charging handle assembly, comprising:

a rigid main body having a long bar with a T distal end and a tail end;

a left polymer portion, and a right polymer portion, wherein the two polymer portions are substantially mirror images of each other and jointly defining a concave space configured to fit over the T distal end, wherein the right polymer piece further has a hook shape latch containing a small protrusion, said hook shape latch is made to have limited elasticity for slidably hooking into a hole formed as a charging handle notch on an upper receiver of a rifle.

8. The charging handle assembly of claim 7, wherein each of the left and right polymer pieces further has a click tab with a small protrusion formed at a distal end of the click tabs, and two matching click holes are made on the T distal end for receiving the click tabs, and wherein the T distal end has two out-extending pegs for snugly inserting into corresponding insertion holes on the two polymer pieces, wherein the small protrusion is a hook tooth with a negative rake angle when engaged to the charging handle notch of an upper receiver.

* * * * *